United States Patent [19]

Schlage

[11] 3,951,442

[45] Apr. 20, 1976

[54] PIVOTING LATCH AND LOCK

[75] Inventor: Ernest L. Schlage, Burlingame, Calif.

[73] Assignee: Schlage Lock Company, San Francisco, Calif.

[22] Filed: July 11, 1974

[21] Appl. No.: 487,766

[52] U.S. Cl. ..... 292/71; 292/78; 292/192; 292/201; 292/210

[51] Int. Cl.[2] ..... E05C 3/06; E05C 3/22; E05C 5/00; E05C 19/02

[58] Field of Search ..... 292/71, 78, 201, 227, 292/70, 191, 192

[56] References Cited

UNITED STATES PATENTS

| | | | |
|---|---|---|---|
| 307,281 | 10/1884 | Farrar | 292/78 X |
| 326,626 | 9/1885 | Chubb et al. | 292/78 |
| 776,073 | 11/1904 | Levy | 292/78 |
| 788,193 | 4/1905 | Dovas | 292/78 |
| 2,752,184 | 6/1956 | Hammond | 292/71 |
| 3,583,737 | 6/1971 | Tutikawa | 292/71 X |
| 3,652,113 | 3/1972 | Odend'hal et al. | 292/227 X |

FOREIGN PATENTS OR APPLICATIONS

| | | | |
|---|---|---|---|
| 148,202 | 3/1882 | France | 292/71 |
| 1,777 | 2/1885 | United Kingdom | 292/78 |
| 4,645 | 2/1890 | United Kingdom | 292/78 |
| 61,023 | 9/1954 | France | 292/78 |
| 683,314 | 11/1952 | United Kingdom | 292/201 |
| 1,353,474 | 8/1962 | France | 292/201 |
| 8,325 | 10/1897 | Sweden | 292/227 |
| 1,178,110 | 1/1970 | United Kingdom | 292/201 |

*Primary Examiner*—Casmir A. Nunberg
*Assistant Examiner*—Carl F. Pietruszka
*Attorney, Agent, or Firm*—Lothrop & West

[57] ABSTRACT

A pivoting latch and lock for a door hinged in a frame having a strike aperture has a detent latch that can be moved out of the strike opening merely by pulling the door open unless the detent latch is specially blocked against such movement. In one embodiment a frame is installed on the door and presents an edge opening. Normally spring-projected partly through the edge opening is a detent latch having a central body carrying one or more pivot lugs guiding rotation of the detent latch about one or more axes located within the frame and alongside the detent latch. The detent latch has a surface associated with each axis so shaped as to clear the frame opening when the latch is rotated about that axis. A lever is pivoted on the frame to move into and out of a position blocking rotation of the detent latch. The lever may be operated by a solenoid or electromagnet. If desired, the same electrical device can move the two levers of duplicate pivoting latches.

3 Claims, 13 Drawing Figures

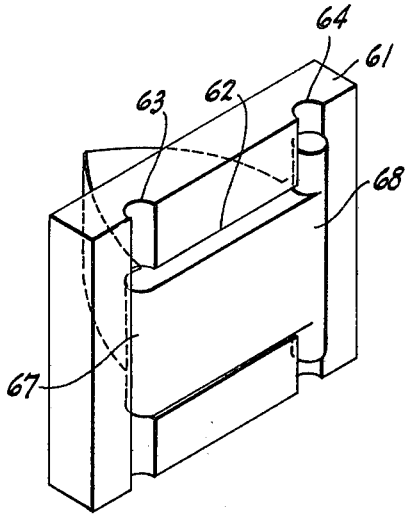
FIG-3
FIG-4
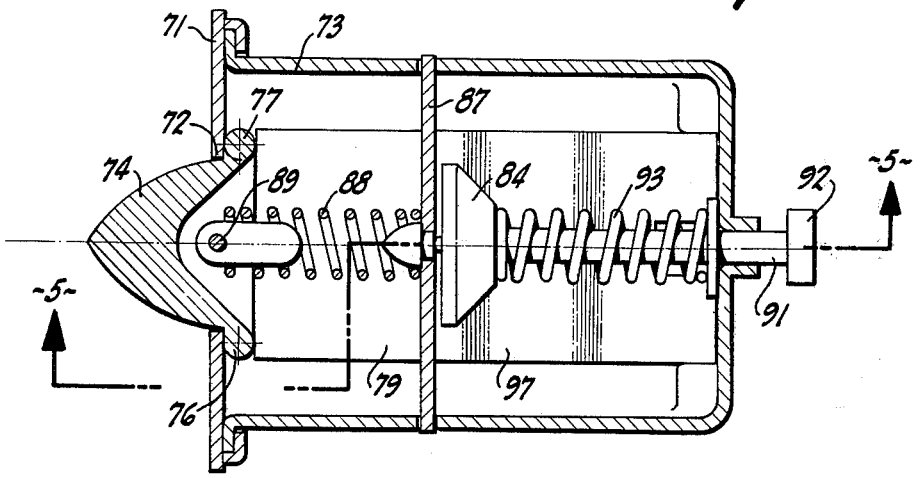
FIG-5
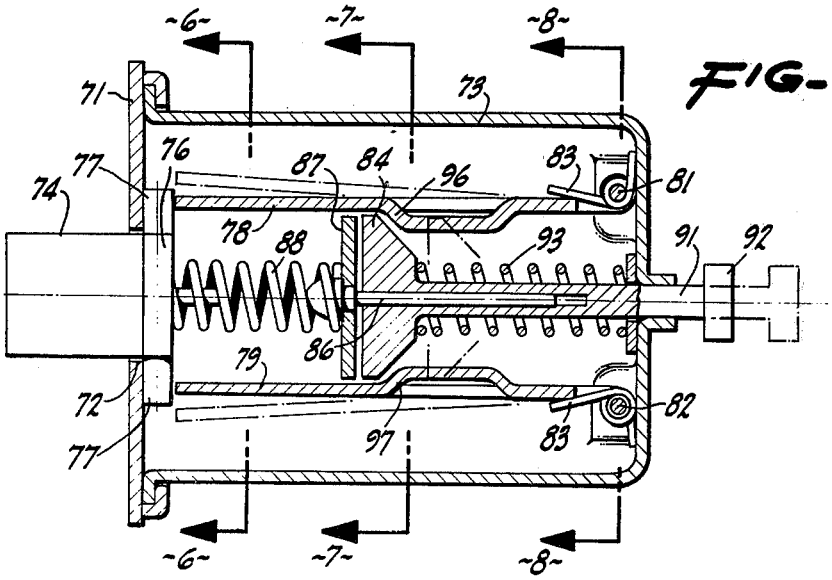

FIG-9
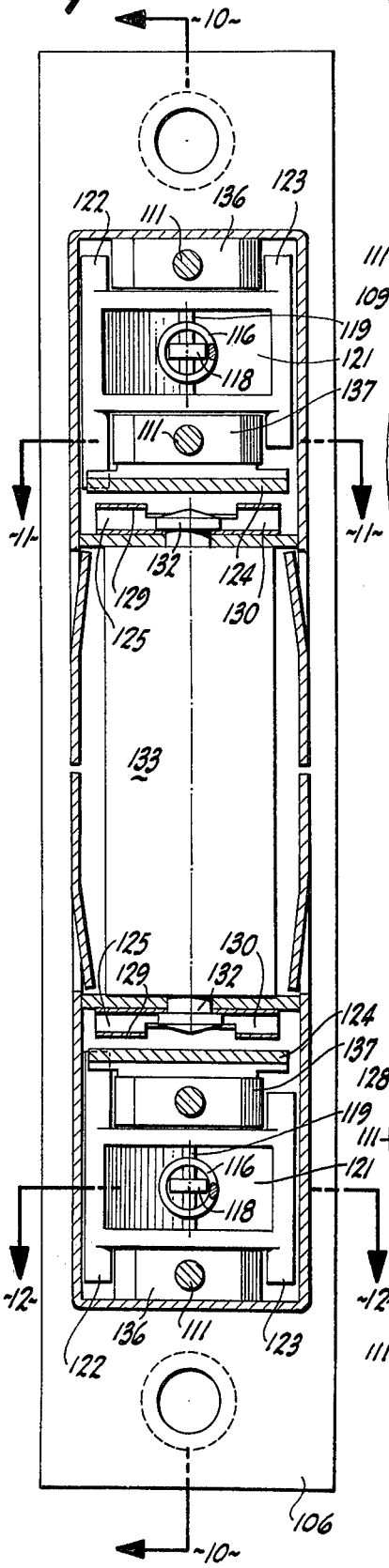
FIG-10
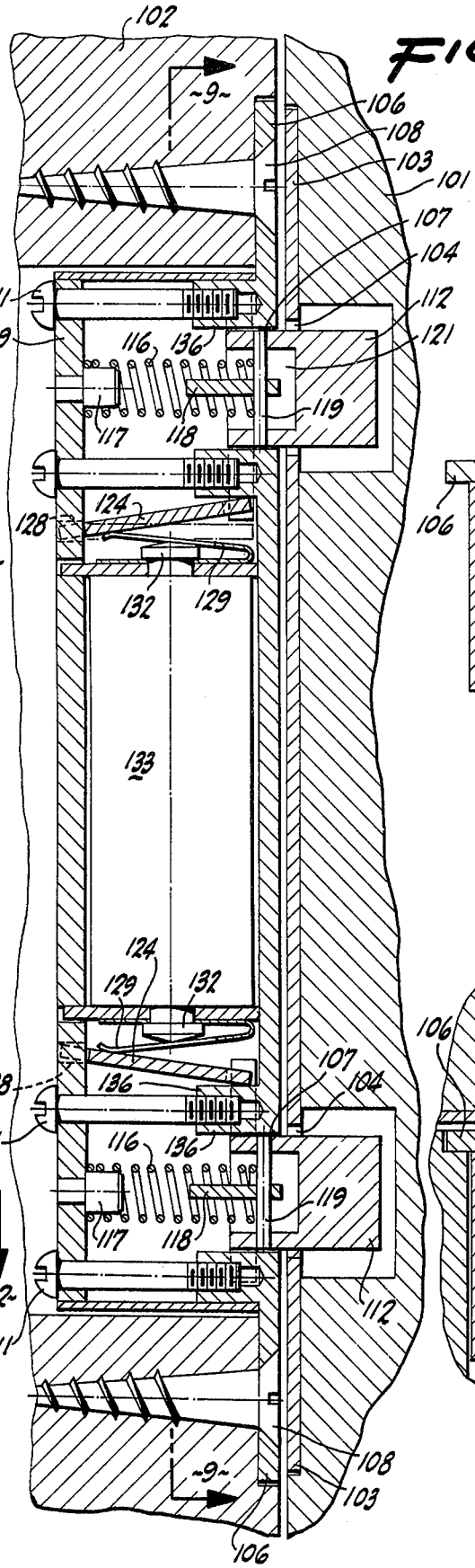
FIG-11
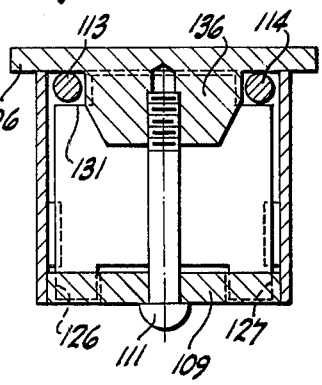
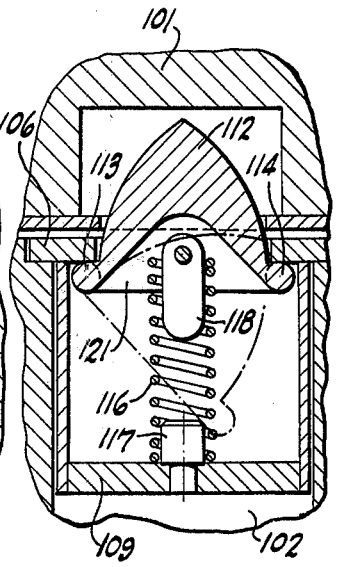
FIG-12

PIVOTING LATCH AND LOCK

The closest art known to the applicant at present is the patent to Ellis U.S. Pat. No. 2,772,108 of Nov. 27, 1956.

In retention hardware for a door mounted to hinge about a vertical axis at one side of the door jamb, it is customary to provide a strike plate having an aperture therein. The retention or lock mechanism on the door usually includes some sort of bolt movable into and out of the aperture in the strike plate to hold the door closed unless the user turns a knob or takes some similar action to withdraw the latch bolt or dead bolt from the strike aperture. In many locks the bolt slides with respect to the strike, but in other locks the bolt pivots about an axis parallel to the hinge axis of the door.

There is a requirement for a door retention device that will be secure or locked firmly when desired but which can be released to allow swinging of the door merely by pulling or pushing upon the door knob without rotating it. In some instances there is a requirement for remote control of the lock and release events. In the present instance attention is directed to such devices employing pivoted bolts operable to release the door without prior retraction yet blocked against retraction when properly controlled, particularly from a remote point. This kind of bolt is referred to herein as a detent latch.

It is therefore an object of the invention in general to provide an improved detent latch.

Another object of the invention is to provide a detent latch in which the operation of the latch when free requires no initial retraction and in which the latch can be held against movement.

Another object of the invention is to provide a detent latch of a simple, straightforward nature.

A further object of the invention is to provide a pivoting latch that can easily be arranged for left-hand or right-hand installation.

Another object of the invention is to provide a pivoting latch which can easily be arranged for remote control.

A still further object of the invention is to provide a pivoting latch that is simple and inexpensive enough to permit the use of multiple latches on a single door panel.

A further object of the invention is to provide for simultaneous actuation of a number of pivoting latches.

A still further object is, in general, to provide an improved pivoting or detent latch.

Other objects, together with the foregoing, are attained in the embodiments of the invention described in the accompanying description and illustrated in the accompanying drawings, in which:

FIG. 3 is a view comparable to FIG. 2 with many portions removed and showing a variation in the construction of parts of the pivoting latch;

FIG. 4 is a cross-section on a generally horizontal, median plane through a modified form of pivoting latch pursuant to the invention;

FIG. 5 is a cross-section the planes of which are indicated by the line 5—5 of FIG. 4;

FIG. 9 is a cross-section on a generally vertical transverse plane through a further modified form of pivoting latch structure, the plane of section being indicated by the line 9—9 of FIG. 10;

FIG. 10 is a showing of the structure of FIG. 9 mounted and in cross-section the plane of which is indicated by the line 10—10 of FIG. 9;

FIG. 11 is a cross-section the plane of which is indicated by the line 11—11 of FIG. 9;

FIG. 12 is a cross-section the plane of which is indicated by the line 12—12 of FIG. 9.

Figure 1:
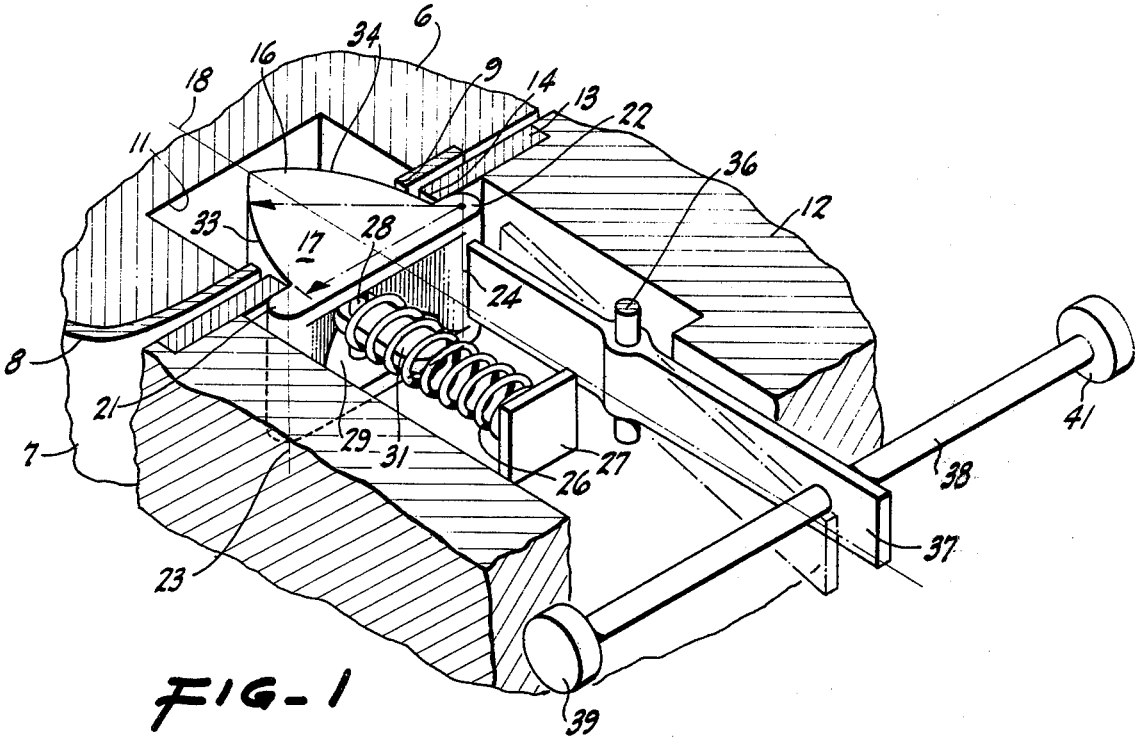
FIG. 1 is a diagrammatic view in isometric perspective showing one form of pivoting or detent latch constructed pursuant to the invention.

In a representative installation, as particularly illustrated in FIG. 1, there is provided a door jamb 6 on which is mounted a strike 7 having a curved entrance lip 8 and incorporating an aperture 9 affording access to a box 11 or recess within the jamb 6. Mounted by means (not shown) to afford swinging movement about a vertical axis with respect to the jamb 6 is a door panel 12 shown in closed position. This panel serves as a mounting or frame for various parts. On the edge of the panel 12 adjacent the strike 7 is a frame plate 13 partly exposed on both sides and having an opening 14 therein. In the closed position of the panel the opening 14 approximately registers with the aperture 9. When the door panel 12 swings the opening and the aperture move out of registry.

Associated with the frame plate 13 is a latch or detent latch including a central body 17 disposed symmetrically about a central plane extending vertically and illustrated by the broken line 18 in FIG. 1. Included with the latch is a pair of rounded projections or pivot lugs 21 and 22 disposed symmetrically of the plane 18. Each lug has its own axis. The pair of lug axes 23 and 24 are parallel to and symmetrical with respect to the plane 18.

The pivot lugs 21 and 22 are urged into abutment with the exposed interior side of the frame plate 13 by a coil spring 26. One end of the spring is seated against an abutment 27 fixed with respect to the frame plate 13 and the other end of the spring bears on a pin 28 spanning a recess 29 in the central body 17. A guide plate 31 mounted on the pin 28 extends into the spring for a short distance. The central body 17 of the length is flat top and bottom and on the sides is defined by a pair of detent surfaces 33 and 34 shaped by circular-cylindrical arcs centered by the respective axes 23 and 24 and so symmetrical with the central plane 18. The surfaces 33 and 34 have adequate clearance to swing about either axis through the opening 14.

With the described structure, a force inwardly along the plane 18 exerted on the point of the central body 17 moves both pivot lugs 21 and 22 inwardly away from the frame plate 13 and further compresses the spring 26. A transverse or lateral force exerted on one side of the central body 17 near the tip rotates the latch around one of the axes (say the axis 23) with the pivot lug 21 serving as a bearing against the rear face of the frame plate 13, and further compressing the spring 26. An opposite lateral force on the other surface rotates the detent about the other axis 24, the other pivot lug 22 serving as a bearing and the spring being compressed. During such rotary motions, there is rubbing between the arcuate surfaces 33 or 34 and the edges of the plate 13 at the opening 14. If the door panel 12 is swung toward the left in FIG. 1, say by pulling a door knob or pushing the panel itself, abutment of the edge of the strike aperture 9 and the adjacent detent surface 33 causes the latch to pivot about the axis 23 and retreat within the door panel 12. The door is easily opened. As the latch loses contact with the strike plate 7, the spring 26 restores the latch to its fully projected position.

Upon a return swing of the door panel, the curved nose 8 of the strike abuts the detent surface 34 and pivots the latch about the axis 24 against the resistance of the spring 26. The pivot lug 22 serves as a bearing against the back of the frame plate 13. The latch is depressed into the door panel so that the strike 7 is readily traversed. The spring 26 then projects the latch 16 into the strike box 11 and into a yieldable, panel-retaining position.

A similar action takes place when the panel 12 is moved to swing in the opposite direction, towards the right in FIG. 1, the edge of the jamb 6 then acting as a strike.

In most instances the detent or latch is restrained to serve as a locking bolt. As shown in FIG. 1, there may be provided in the door panel 12 a fulcrum mounting 36 on which a lever 37 is supported to swing between the full line and broken line positions. In the full line position, an end of the lever 37 is in the path of inward movement of the pivot lug 22 and blocks that lug from leaving the inner face of the frame plate 13. When there is such restraint a transverse or lateral force on the surface 33, such as is present when the door panel is pulled to the left in FIG. 1, and which normally tends to pivot the latch around the axis 23 and swing the pivot lug 22, cannot produce any movement. The latch or detent cannot retreat. Its abutment with the aperture side in the strike 7 restrains the opening movement of the door panel 12 in that direction. The door panel can be swung in the opposite direction. In its other, broken line position, the end of the lever 37 is completely out of the path of the pivot lug 22 so that there is no restraint on that lug and so none on the door panel.

Means are provided for operating the lever 37 manually. A through rod 38 projects from opposite sides of the door panel and has buttons 39 and 41 at the end thereof. Button operation moves the lever 37 into a locking position or into a releasing position from either side. The user has an option of having, in effect, a spring-pressed detent for light restraint and push-pull opening of the door panel or having a locking mechanism for holding the door panel against movement in one direction with respect to the jamb.

Figure 2:
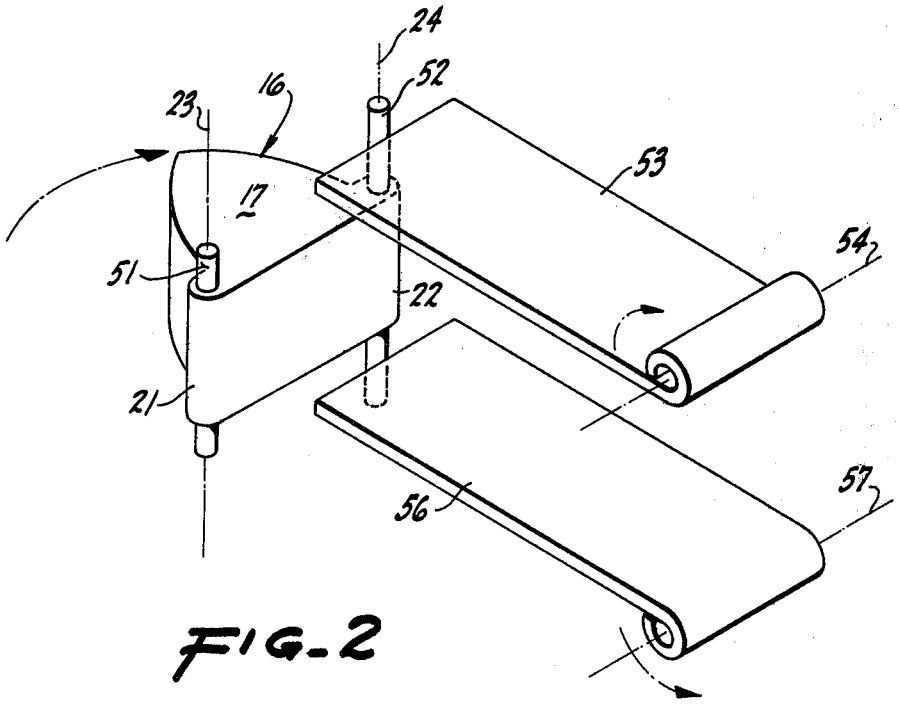
FIG. 2 is a schematic view comparable to FIG. 1 and with certain parts removed but showing another form of pivoting latch.
Figure 6:
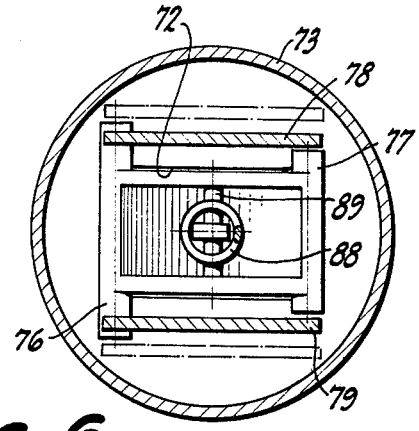
FIG. 6 is a cross-section the plane of which is indicated by the line 6—6 of FIG. 5.
Figure 7:
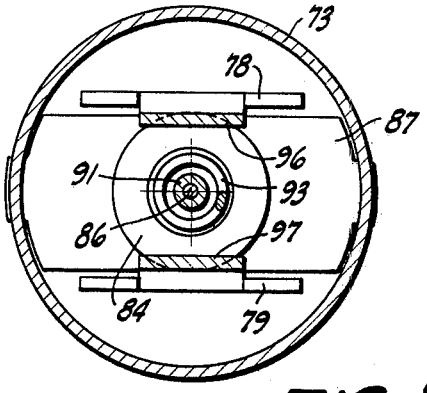
FIG. 7 is a cross-section the plane of which is indicated by the line 7—7 of FIG. 5.
Figure 8:
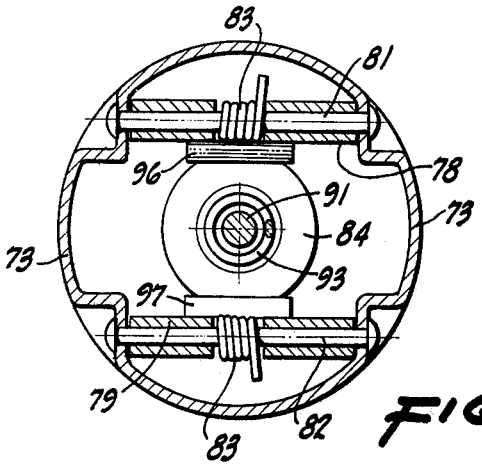
FIG. 8 is a cross-section the plane of which is indicated by the line 8—8 of FIG. 5.

The lever 37 effectively swings about an axis 36 parallel to the plane 18 but sometimes another arrangement is preferred. As shown in FIG. 2, with some parts of FIG. 1 being omitted, the lugs 21 and 22 are extended by rods 51 and 52. The rod 51 extends above and below a predetermined distance whereas the rod 52 extends above and below a greater predetermined distance. The lever 37 is replaced by an upper lever 53 movable about a transverse pivot axis 54 and by a lower lever 56 movable about another transverse pivot axis 57 both axes being normal to the plane 18.

With the arrangement when the levers 53 and 56 are simultaneously disposed in their approximately parallel position, as shown in FIG. 2, they restrain the long rods 52 and block the pivot lug 22. The same result is achieved as when the lever 37 blocks the pivot lug 22 in FIG. 1. However, when the lever 53 is rotated clockwise and the lever 56 is rotated counterclockwise then the long rods 52 are cleared and are no longer blocked and can move in between the spread levers 53 and 56. The latch or detent can then be depressed for the same effects as described above.

It is preferred to have an improved lateral restraint of the latch. As shown particularly in FIG. 3, the frame plate 61 has an opening 62 therein as before, but is thick enough to include a pair of arcuate grooves 63 and 64 symmetrically disposed with respect to the center plane and parallel thereto, each groove being substantially semicircular in plan and being designed easily to receive rounded pivot lugs 67 and 68, the latter having bearing extensions. These lugs serve as before and are not confined in a direction away from the frame plate 61 but are well confined in a transverse direction.

In a comparable but elaborated version of the device, as shown in FIGS. 4 to 8 inclusive, there is afforded a frame plate 71 having an opening 72 therein and included in a frame 73. Projecting through the opening 72 is a symmetrical latch 74 or detent having pivot lugs 76 and 77. The long lug 77 is released or restrained by a pair of levers 78 and 79. Each lever is carried by a respective one of a pair of pivot pins 81 and 82 mounted in the frame 73. Springs 83 urge the levers toward each other into a position behind and blocking the long pivot lug 77, but the levers are movable into positions away from and freeing the pivot lug 77. The levers are conveniently actuated by a wedge 84 guided on a central rod 86 (FIG. 5) supported in a transverse frame plate 87. The plate 87 also supports one end of the coil spring 88, the other end of which presses against a cross rod 89 in the latch 74 (FIG. 4). The wedge 84 is fast on an operating rod 91 having a thumb button 92 thereon. The wedge is impelled in one direction by a spring 93 abutting the wedge and also the frame 73.

The spring 88 normally projects the latch or detent 74. With the wedge 84 in the position shown in FIG. 5, the levers 78 and 79 block inward swinging movement of the latch about the lug 77 so that the door on which the latch is mounted, when closed is locked against swinging movement in one direction and when open can be swung shut and restrained in closed position. When the thumb button 92 retracts the rod 91 from the housing and compresses the spring 93 the wedge 84 cams against offset portions 96 and 97 (FIG. 5) in the levers and spreads the levers into their non-locking position. In that instance, the latch 74 can be depressed or swung in either direction as initially described. If it is desired to have the detent serve as a bolt restraining door panel movement in either direction from normal, closed position, it is merely necessary to extend the lug 76 to duplicate the long lug 77. Then the levers 78 and 79 lie behind and in abutment with both lugs and the latch 74 cannot be depressed or swung at all.

A practical arrangement is particularly illustrated in FIGS. 9 to 12, in which an installation is made between a jamb 101 and a swinging door panel 102. In this instance the mechanism is duplicated, the description of one part relating to the other part as well. The jamb 101 receives a duplex strike 103 having spaced apertures 104 therein. The door panel 102 carries a frame plate 106 having duplicate openings 107 therein. The frame plate 106 is held in position by screws 108 and includes a back plate 109 and fasteners 111, so that in effect a box frame is afforded.

Extending through a frame plate opening 107 is a latch body 112 or detent having extended pivot lugs 113 and 114 symmetrically disposed at the opposite sides thereof. The latch is normally urged outwardly through the opening by a coil spring 116 seated on a central frame lug 117 and on a guide 118 journalled on a pivot pin 119 spanning a recess 121 in the latch body 112. There are bearing extensions 122 and 123 on the lugs 113 and 114, all of substantially the same length except that the interiorly directed portion of the extension 122 on the lug 113 is longer.

Designed to cooperate with the interiorly directed part of the lug extension 122 is a lever 124 having end tabs 126 and 127 (FIG. 11) seated in notches 128 in the frame plate 109. The lever 124 is thus loosely pivoted for swinging movement in an up and down direction at its free end. A bent leaf spring 129, bifurcated to form legs 125 and 130, urges the lever 124 toward the adjacent, long pivot lug extension 122. The free end of the lever 124 at least in the corner underlying the long extension 122 of the lugs is interrupted by a notch 131 cut from it.

To actuate the lever 124 against the urgency of the spring 129 there is provided an electrical device. This is preferably a solenoid or electromagnet referred to interchangeably herein. Conveniently a core 132 projects at one end from a single electromagnet 133 mounted on the frame. The core also projects from the opposite end to actuate simultaneously a duplicate structure in the lower part of the mechanism.

When the electromagnet is de-energized and the parts are in the full line position as shown in FIGS. 9 and 10, each lever 124 is urged toward its latch or detent and the notches 131 as well as the side of the frame and the frame plate confine the long extensions 122 of the pivot lugs 113. When an attempt is made to swing the door panel to the right in FIG. 12, the long extensions 122 abut the levers 124 as barriers and the latch is blocked from swinging about the axis of the pivot lugs 114. Although the restraining forces are symmetrical and off center, nevertheless the parts fit closely enough to each other so that the latch is properly restrained. When the electromagnet 133 is energized and the levers 124 are attracted thereto, they move out of the paths of the long extensions 122 of the pivot lugs 113. The latches can then be swung counterclockwise and withdrawn later being restored by the springs 116. The latches can always be swung inwardly and clockwise (in FIG. 12) since in all positions, the levers 124 are out of the paths of the lugs 114. If an absolute lock for both directions is required, the lug 114 can also be extended interiorly so that the levers 124 block movement of both of the pivot lugs 113 and 114 unless the electromagnet 133 is energized to move the levers 124 out of the way of both long extensions.

Transverse forces on the latch should be well resisted. While the arcuate surfaces of the latch can slide over the boundary walls of the strike aperture 104, this is accompanied by substantial friction. To avoid this, there is provided at least one and preferably a pair of reaction blocks 136 and 137 (FIGS. 9 and 11) on opposite ends of the latch so as to be adjacent the path of swinging movement of both ends of the outstanding pivot lugs 113 and 114. When there is a transverse or lateral force on the latch, there is sufficient clearance between the sides of the latch and its frame plate so that the pivot lugs 113 and 114 bear against the sides of the reaction blocks. The friction force during pivoting of the latch is thus very much reduced.

Figure 13:
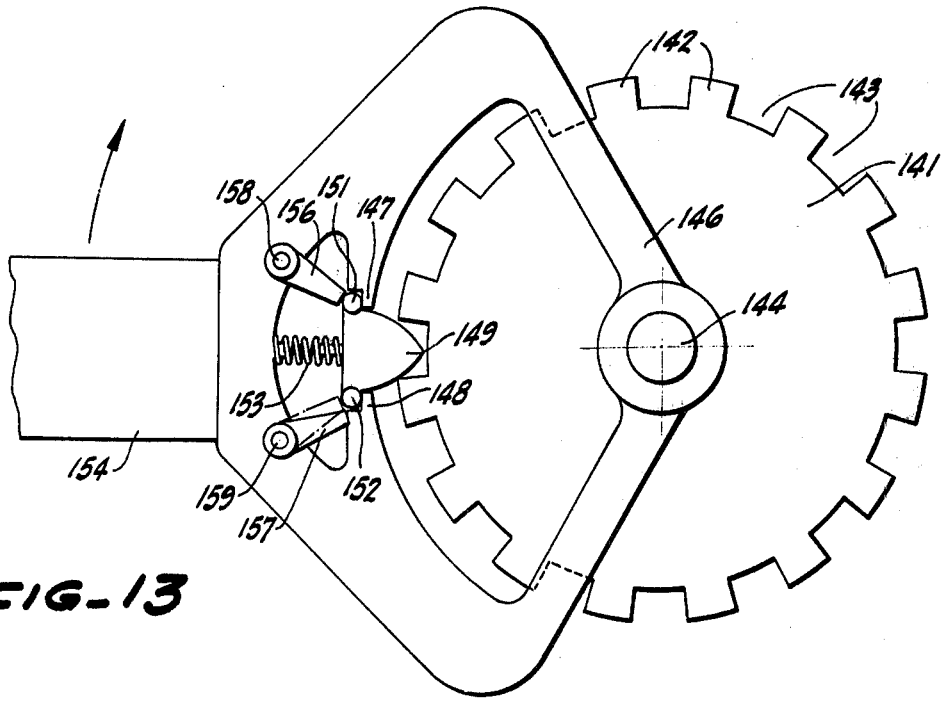
FIG. 13 is a diagrammatic showing in plan of an adaptation of the pivoting or detent latch in a different form of swinging mechanism.

The pivoting latch or detent latch of this disclosure is adaptable to various types of relatively stationary and swinging structures and an example thereof is shown in FIG. 13. In this instance, the stationary member 141 is a circular disc with teeth 142 spaced apart around its periphery and separated by notches 143. Centrally mounted in the disc is an upstanding shaft 144 on which a yoke 146 is rotatably mounted. The yoke includes a frame plate 147 integrally formed therewith and defining an opening 148. Projecting through the opening is a latch body 149 having pivot lugs 151 and 152 thereon. A spring 153 normally urges the latch body 149 into one of the adjacent notches 143. The yoke 146 has an extension 154 which can represent a door panel or a lever or a comparable device rotatable about the axis of the shaft 144.

Mounted on the yoke 146 is a pair of levers 156 and 157 each able to turn about its own pivot 158 and 159, the axes of which are parallel to each other and are symmetrically disposed with respect to a central plane coincident with the axis of the shaft 144. When both of the levers 156 and 157 are positioned in the path of the pivot lugs 151 and 152, the latch 149 is not retractable and the extension 154 cannot be rotated with respect to the member 141. However, if one of the levers, such as 157, is moved to one side as shown in full lines in FIG. 13, then a lateral or counterclockwise force on the latch 149 is effective to overcome the spring 153 and to move the pivot lug 152 past the lever 157 and to permit the latch 149 to withdraw from the adjacent notch 143 during relative movement of the members 154 and 141. This permitted movement is in one direction, since movement in the other direction is still blocked because the pivot lug 151 cannot retreat because of the position of the lever 156. By repositioning the lever 156 the parts can turn relatively in the opposite direction. If both levers are moved out of the way of their respective pivot lugs, then the detent latch 149 can be fully depressed and the part 154 can be moved in either or both directions.

What is claimed is:

1. A pivoting latch and lock for a hinged door movable with respect to a door jamb having a strike opening therein comprising a frame adapted to be installed on said door, a detent bolt, means supporting said detent bolt at one side on said frame for swinging movement in a predetermined path between a projected position in said opening and a retracted position out of said opening, half-journal means included in said supporting means for precluding movement of said detent bolt from side to side on said frame while allowing said detent bolt to move away from said frame, means for resiliently urging said detent bolt toward said projected position, and means on said frame movable between a first position out of said path and a second position in said path for blocking said swinging movement of said detent bolt; and a second latch similar to said latch and including a duplicate pivot lug in substantial alignment with at least one of said pivot lugs, a second lever movable into and out of a position blocking movement of said duplicate pivot lug, and a single electromagnetic means mounted on said frame between said levers for simultaneously operating said lever and said second lever.

2. In a pivoting latch and lock for a hinged door, having a frame plate adapted to be installed on said door, an opening in said frame plate, a detent bolt extending through said opening and arranged to pivot inwardly of said opening about either of two parallel axes at opposite sides of said opening, the improvement comprising: inwardly facing semi cylindrical grooves in said frame plate at said opposite sides of said opening and concentric to said respective axes, generally cylindrical pivot lugs on opposite sides of said detent bolt extending substantially the full height thereof and seated in said respective grooves, each groove extending the full height of said opening and each having a portion engaging its lug in a region between its axis and the other lug to prevent movement of said bolt in a direction toward the other side of said opening when said bolt pivots about one side thereof; resilient means urging said bolt outwardly wherein both said lugs are in their respective grooves; and means on said frame movable between a first position blocking movement of at least one of said lugs out of its groove and a second position permitting movement of said lug out of its groove.

3. A pivoting latch as defined in claim 2 wherein one of said pivot lugs extends axially a distance greater than said height, said last named means being positioned to block said extending portion of said one pivot lug from moving out of its groove.

* * * * *